United States Patent [19]

Björn et al.

[11] 4,381,270

[45] Apr. 26, 1983

[54] METHOD OF PRODUCING A FLASH SUPPRESSED PRESSED ROCKET PROPELLANT

[75] Inventors: Lars-Erik Björn; Mats Olsson; Olof Öman, all of Karlskoga, Sweden

[73] Assignee: Aktiebolaget Bofors, Bofors, Sweden

[21] Appl. No.: 141,731

[22] Filed: Apr. 18, 1980

[30] Foreign Application Priority Data

Apr. 24, 1980 [SE] Sweden ..... 7903578

[51] Int. Cl.[3] ..... C06B 45/12

[52] U.S. Cl. ..... 264/3 B; 102/285; 102/286; 102/287; 102/291; 149/14; 264/3 A

[58] Field of Search ..... 149/14; 102/285, 286, 102/287, 291; 264/3 A, 3 B

[56] References Cited

U.S. PATENT DOCUMENTS 3,217,651 11/1965 Braun ..... 102/287

3,718,094 2/1973 Bermender ..... 102/287

*Primary Examiner*—Paul R. Michl

*Attorney, Agent, or Firm*—Pollock, Vande Sande & Priddy

[57] ABSTRACT

A method of producing pressed rocket propellant with good flash suppression and a high burning velocity, i.e. containing optimal quantities of flash reducing agent and catalysts. The meethod is characterized by the entire quantity of flash reducing agent required in order to achieve the result desired being mixed into a separate quantity of propellant while the entire quantity of catalysts required in order to achieve the result desired is mixed into the remaining quantity of propellant, after which these propellants containing either flash reducing agent or catalysts are converted into an appropriate form and mixed in layers or in its entirety and thereafter pressed into the form desired. In the body of propellant obtained, the flash reducing agent and catalysts will be separated, and will not interfere with each other's function.

11 Claims, 3 Drawing Figures

METHOD OF PRODUCING A FLASH SUPPRESSED PRESSED ROCKET PROPELLANT

Figure 1:
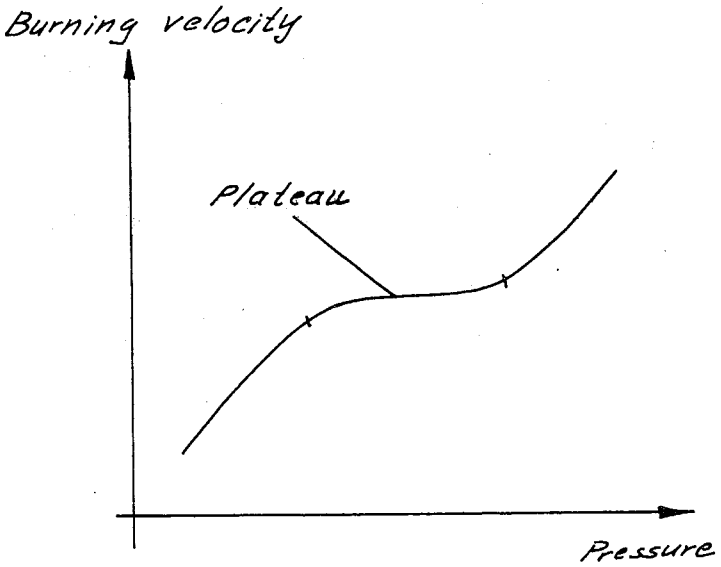

The present invention relates to a method of producing flash suppressed pressed cellulose nitrate based double base rocket propellant.

On the basis of the manufacturing method, it is usual to distinguish between cast and pressed rocket propellant. Chemically seen, as a rule, rocket propellants are so-called double base propellant, i.e. they consist of more than 50 percent by weight of cellulose nitrate plus low-molecular nitrate esters, usually consisting of glycerol trinitrate or diglycol dinitrate.

Cast rocket propellants are prepared by starting with a single base cellulose nitrate powder, i.e. a propellant containing none or, at the most, a small quantity of low-molecular nitrate esters, and filling in a granular condition into a vessel with the same form as the desired configuration of the propellant. After this a casting fluid, mainly consisting of glycerol trinitrate in a sufficient quantity, is added under pressure so as to entirely fill out the spaces between the grains of powder. Thereafter, the body of propellant thus obtained is subjected to a homogenizing heat treatment at an elevated temperature for several days. This procedure gives a homogeneous body of propellant of the double base type.

Pressed rocket propellant is produced by first making a rolled mat of double base powder in a conventional way. The mat in rolled up form is inserted in a pressing chamber, where through the influence of a piston or the like it is transformed to the form desired.

In order that both the pressed and the cast propellant may be given a burning velocity which is sufficiently high and relatively independent of pressure, comparatively high contents of combustion modifiers or catalysts must be added to the propellant, which are mixed into the powder base in connection with the manufacture of this, regardless of whether this powder base is to be used for the manufacture of a cast of a pressed propellant. The adding of the catalyst does not in itself pose any major problem, but on the other hand, in the case of pressed rocket propellant, there have previously been great difficulties involved in extinguishing the flame which has been formed as a tail behind the rocket motor, since propellant gases which have not been entirely consumed and which leave the rocket motor are ignited and burned in the atmosphere behind it.

The fact is that, in order to be able to suppress the flame in question to a level acceptable for military purposes, such large quantities of the flash reducing agents known at present, such as certain salts of alkali metals or other compounds containing alkali metal ions, must be added that these will seriously interfere with the influence of the catalysts on the burning velocity of the propellant.

The problem of the flash reducing agent interfering with the influence of the catalysts on the powder are applicable in principle also to cast rocket propellant, but in this case the problem was solved as early as around 1956. The solution to the problem as regards cast rocket propellant is thus described in inter alia U.S. Pat. No. 3,960,621.

The procedure described in said patent is based in principle on two sets of single base or possibly double base cellulose nitrate based powder being manufactured with a maximum glycerol trinitrate content of 35 percent by weight, of which a first larger batch is given an appropriate content of catalyst, but is entirely free from flash reducing agent, while a second, smaller batch of powder is given a high content of flash reducing agent, but is entirely free from catalysts.

The U.S. Pat. No. 3,960,621 mentions as appropriate catalysts, lead stearate, lead citrate, lead salicylate, lead 2,4-dihydroxy benzoate, lead sulphite, lead oxide, copper oxalate, copper salicylate, copper 2,4-dihydroxy benzoate, and copper II oxide. For the sake of completeness it can also be mentioned that potassium cryolite and carbon black, i.e. soot, in small quantities of about 1.0–0.1 percent by weight, have also proved to be very good catalysts, particularly for pressed rocket propellant.

The catalysts mentioned in said U.S. patent must be added in quantities totalling up to 6–7 percent by weight, but several different catalysts are then often added simultaneously.

The flash reducing agents mentioned in said U.S. patent consist of the alkali salts such as potassium sulphate, potassium nitrate, potassium aluminum fluoride, and potassium hydrogen tartrate, generally used for this purpose.

According to U.S. Pat. No. 3,960,621, the sizes of the two batches of powder should have a ratio of approximately 3:1.

In the two batches of powder, the contents of catalyst and flash reducing agent are now to be adapted so that the total quantity of powder when the two batches have been dry mixed will have both the content of catalyst desired and the content of flash reducing agent desired. After the mixing of the batches of powder, the "casting" is carried out, i.e. the glycerol trinitrate based casting fluid is added, and the heat treatment takes place, in a known way.

In a cast rocket propellant produced in the way described above, the catalysts and the flash reducing agents do not seem to interfere with each other, since these additives, although they are substantially uniformly distributed in the body of propellant, are still separate.

The present invention relates to a method of producing pressed rocket propellant with good flash suppression and a high burning velocity, i.e. a rocket propellant containing optimal quantities of flash reducing agent and catalysts added under such circumstances that these components do not interfere with each other at the burning of the propellant.

According to the invention, using a known technique, a double base powder paste is made, containing 50–65 percent by weight cellulose nitrate, one or a few percent by weight stabilizers e.g. in the form of Acardite or Centralite or possibly some triacetin or other usual softener for powder, and the remainder substantially consisting of glycerol trinitrate or some other low-molecular nitrate ester.

From this powder paste, a first, smaller batch is taken, into which an appropriate flash reducing agent is mixed. The flash reducing agent can consist of sodium antimonate, potassium hydrogen tartrate, or any of the previously mentioned conventional flash reducing agents which are known in themselves. The content of flash reducing agent mixed in should be determined through practical tests. However, the highest appropriate content of flash reducing agent should be approximately 50 percent by weight, but unless an extremely high content of flash reducing agent is desired in the finished propellant, a considerably lesser admixture, e.g. 10 or 20 percent, can be sufficient.

The quantity of flash reducing agent mixed in should be so high that it corresponds to the content of flash reducing agent desired for the whole of the quantity of powder paste originally prepared.

After the admixture of the flash reducing agent the powder paste is rolled between heated rolls into mats with a thickness of approx. 1.0 mm which can be cut up into grains, for instance with a size of 1.5×1.5 mm.

The quantity of catalyst which is appropriate to give the propellant the burning properties intended is thereafter mixed into the second, remaining, larger batch of powder. After the dry admixture of the catalyst, also this batch of powder is rolled, and can thereafter, as in the case of the smaller batch of powder with the flash reducing agent, be cut up into grains in the same way.

These two batches of granular powder are thereafter dry mixed. The first, smaller batch of propellant, which is thus to contain the entire quantity of flash reducing agent, should then comprise approximately 10 percent of the entire quantity of powder. However, the procedure according to the invention has proved to function even with a considerably higher admixture which, however, from the point of view of production, is less practical. After the mixing, the mixture of powder is pressed through a die, with a pressure adapted in such a way that the grains of powder are held together without their identity being lost to any mentionable degree and under such conditions that the original grains of powder are drawn out to form longitudinal veins in the body of propellant then produced.

In certain cases, it can be sufficient to arrange the rolled mats in layers on top of each other, e.g. by placing them on top of each other and rolling these mats into a relatively loosely coherent body of propellant, which is thereafter extruded through a die according to the procedure previously described.

At the extrusion, the propellant is given the cross section form desired. A successively constricted die, preferably provided with a successively tapered centre mandrel in a known way, which can end up with a part of uniform thickness, will thus give a tubular body of propellant.

The method according to the invention has been defined in the following claims, and will now be further described in some representative examples.

Figure 2:
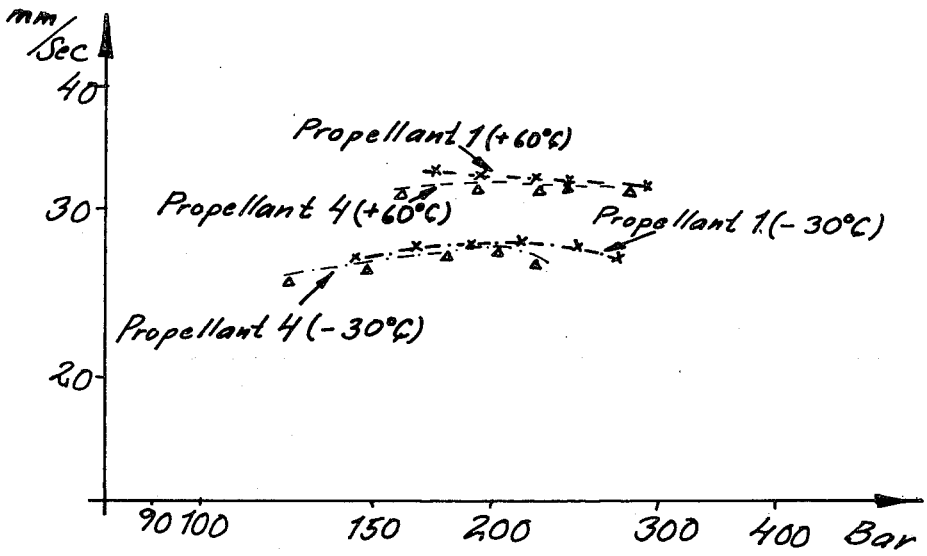
Figure 3:
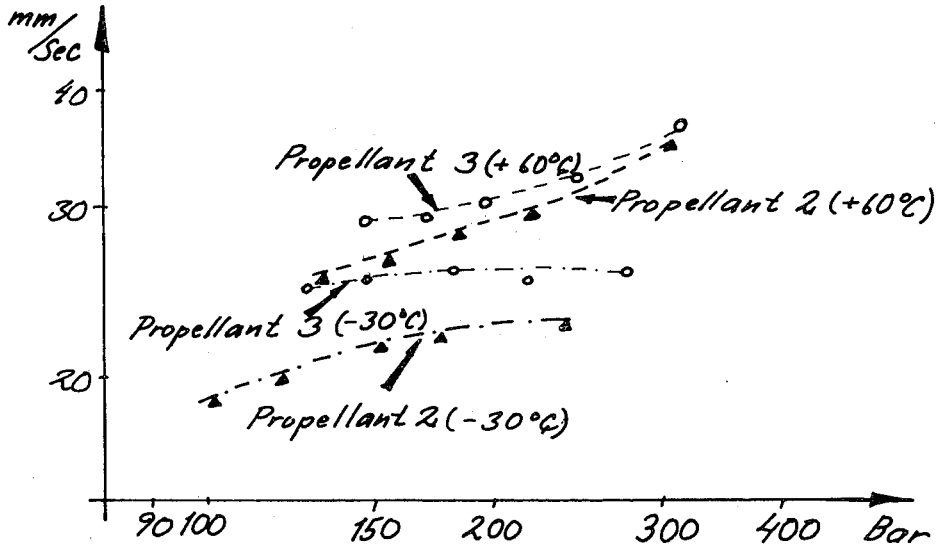

FIGS. 2 and 3 illustrate burning curves for different propellants.

In order to illustrate the invention, reference will be made to the position of the "plateau" in the burning curve for some representative, pressed propellants.

FIG. 1 shows an entirely general burning diagram for a rocket propellant in which the x-axis indicates the pressure in bar and the y-axis the burning velocity in mm/sec. In the general burning curve drawn, it is the more or less horizontal plateau part which is of interest for rocket propellant, as it is within the pressure range of the plateau that the rocket motor is made to work. If the burning velocity is lowered, the plateau is displaced downwards.

In all of the examples given in the following, we have used as a basis a master mixture consisting of a double base propellant containing approximately 60 percent by weight cellulose nitrate, 2 percent by weight stabilizer (Acardite), 4 percent by weight triacetin, and the remainder glycerol trinitrate.

Furthermore, in propellant samples 1 and 4 catalysts have been added in a quantity corresponding to 3 percent by weight lead 2,4-dihydroxy benzoate, plus 3 percent by weight copper 2,4-dihydroxy benzoate, i.e. a total of 6 percent by weight catalysts, all based on the quantity of finished rocket propellant. In propellants 2 and 3 the corresponding quantities of these copper and lead compounds have constituted 2.5 percent by weight each.

The rocket propellants in question were test burned at the two extreme temperatures of −30° C. and +60° C.

The burning curves at +60° C. and −30° C. for propellant 1 are compared in FIG. 2 with the corresponding curves for propellant 4.

Propellant 4 is produced in accordance with the invention, and based on the entire quantity of propellant contains 5 percent by weight sodium antimonate. This quantity of sodium antimonate was originally mixed into 10 percent by weight of the entire batch of propellant, after which the master mixtures thus obtained were rolled into mats and cut up into grains of an appropriate size. In the remaining 90 percent of the batch of propellant all of the above-mentioned catalyst were mixed in, after which also this batch of propellant was rolled into mats and likewise cut up into grains. The two propellants with and without flash reducing agent (sodium antimonate) and with and without catalysts were thereafter dry mixed and conveyed to a press in which the propellant mixture was extruded through a die to the form desired. The rocket propellants then obtained proved to have good flash suppression, and as will be noted from the curves, their "plateau" is almost entirely as good as for the corresponding propellant (propellant 1) without flash reducing agent, i.e. with the method according to the invention it has been possible to practically entirely eliminate the negative effect of the flash reducing agent on the burning modifiers. The fact that the flash reducing agent must be added according to the method characteristic for the invention will be noted from the burning curves shown in FIG. 3 at +60° C. and −30° C. for propellant 2 and propellant 3.

Propellant 3 is a reference propellant entirely without flash reducing agent, but containing the same quantity of burning modifiers as propellant 2. The absence of flash reducing agent and the consequent flame makes propellant 3 unserviceable for practical use, even if it has good values for the rest.

Propellant 2 contains 1.5 percent by weight of the flash reducing agent potassium cryolite which, however, already from the beginning had been uniformly distributed in the entire batch of propellant, together with the previously indicated quantities of catalyst. As will be noted from FIG. 3, this has involved that the burning curves of the propellant have dropped considerably, at the same time as the burning has been disturbed and uneven.

We claim:

1. A method of producing pressed double base rocket propellant with good flash suppression and high burning velocity which comprises providing a powder paste of double base type free from the necessary catalysts and flash reducing agent;

taking a small batch of said powder paste and mixing thereof a flash reducing agent in a quantity adapted to the entire quantity of said powder paste;

mixing into the larger remaining batch of powder paste catalysts in a quantity adapted to the entire quantity of powder paste;

converting the two batches separately through mechanical processing into desired form;

then mixing the two batches of powder together in layers or in its entirety, and then compressing through a die into a coherent body of propellant under such conditions that the two batches of propellant form longitudinal veins in the body of propellant obtained.

2. The method of claim 1 wherein the two batches of propellant are rolled into mats with a thickness of 0.5–2 mm, said mats are placed alternatingly on top of each other and rolled into a loosely coherent body propellant, and then pressed through a die to form a coherent body of propellant.

3. The method of claim 1 wherein the two batches of propellant are rolled into mats with a thickness of 0.5–2 mm, said mats are cut up into grains and dry mixed with each other, and then the mixture of propellant is pressed through a die to form a coherent body of propellant.

4. The method of claim 1, 2, or 3 wherein the small batch of propellant corresponds to 5–15 percent of the entire quantity of powder paste and a maximum of 50% by weight of flash reducing agent is added to said small batch.

5. The method of claim 4 wherein the amount of said flash reducing agent is 10 to 20 percent.

6. The method of claim 1, 2 or 3 wherein the amount of catalysts is 6–7% by weight.

7. The method of claim 1, 2 or 3 wherein the powder paste contains 50–60% by weight of cellulose nitrate and glycerol trinitrate.

8. The method of claim 1, 2 or 3 wherein said catalyst is selected from the group of lead stearate, lead citrate, lead salicylate, lead 2,4-dihydroxy benzoate, lead sulphite, lead oxide, copper oxalate, copper salicylate, copper 2,4-dihydroxy benzoate, copper II oxide, potassium cryolite, carbon black and mixtures thereof.

9. The method of claim 1, 2, or 3 wherein said flash reducing agent is an alkali salt.

10. The method of claim 9 wherein said alkali salt is selected from the group of potassium sulphate, potassium nitrate, potassium aluminum fluoride, potassium hydrogen tartrate and mixtures thereof.

11. A pressed double base rocket propellant obtained by the method of claim 1.

* * * * *